US007819193B2

(12) United States Patent
Savoy et al.

(10) Patent No.: US 7,819,193 B2
(45) Date of Patent: Oct. 26, 2010

(54) PARALLEL FRACTURING SYSTEM FOR WELLBORES

(75) Inventors: Mark J. Savoy, Humble, TX (US); Edward E. Speyrer, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/157,404

(22) Filed: Jun. 10, 2008

(65) Prior Publication Data

US 2009/0301708 A1 Dec. 10, 2009

(51) Int. Cl.
*E21B 43/26* (2006.01)

(52) U.S. Cl. ..... 166/308.1; 166/305.1

(58) Field of Classification Search ..... 166/278
See application file for complete search history.

(56) References Cited

U.S. PATENT DOCUMENTS 2,224,538 A * 12/1940 Eckel et al. ..... 166/278
4,519,451 A 5/1985 Gray et al.
4,541,484 A * 9/1985 Salerni et al. ..... 166/278
4,840,229 A * 6/1989 Proctor et al. ..... 166/381
5,332,038 A * 7/1994 Tapp et al. ..... 166/278
5,396,957 A 3/1995 Surjaatmadja et al.
5,443,117 A 8/1995 Ross
5,730,223 A 3/1998 Restarick
6,065,535 A * 5/2000 Ross ..... 166/51
6,382,324 B1 * 5/2002 Anyan ..... 166/382
6,533,037 B2 3/2003 Eslinger et al.
6,601,646 B2 * 8/2003 Streich et al. ..... 166/278
6,929,066 B2 8/2005 Hill
7,066,265 B2 6/2006 Surjaatmadja
7,096,943 B2 8/2006 Hill
7,331,388 B2 * 2/2008 Vilela et al. ..... 166/278

(Continued)

FOREIGN PATENT DOCUMENTS

EP 1 258 594 A2 11/2002

(Continued)

OTHER PUBLICATIONS

Henry Restarick, Horizontal Completion Options in Reservoirs With Sand Problems, Mar. 11, 1995, pp. 545-560, SPE 29831, Society of Petroleum Engineers, Inc., U.S.A.

(Continued)

*Primary Examiner*—David J Bagnell
*Assistant Examiner*—Kipp C Wallace
(74) *Attorney, Agent, or Firm*—Greenberg Traurig LLP; Anthony F. Matheny

(57) ABSTRACT

Downhole fracturing tools comprise upper and lower isolation devices and a housing disposed in between. The housing comprises a housing bore that is divided into two chambers isolated from each other within the housing bore. The upper bore is in fluid communication with a fluid injection line through which a fracturing fluid is pumped into the upper bore. The fracturing fluid flows down the upper bore, substantially parallel to a longitudinal length of the tool, and exits the tool through at least one port. The fracturing fluid then travels down the wellbore annulus. Returns from the fracturing fluid flow through a screen in the tool and up a return line that empties into the wellbore annulus above the upper isolation device.

20 Claims, 1 Drawing Sheet

U.S. PATENT DOCUMENTS

| | | | | |
|---|---|---|---|---|
| 2004/0140089 | A1 | 7/2004 | Gunneroed | |
| 2006/0118301 | A1 | 6/2006 | East, Jr. et al. | |
| 2006/0283596 | A1 | 12/2006 | Mahdi et al. | |
| 2007/0039741 | A1* | 2/2007 | Hailey | 166/376 |
| 2007/0187095 | A1* | 8/2007 | Walker et al. | 166/278 |
| 2007/0251690 | A1* | 11/2007 | Whitsitt et al. | 166/278 |

FOREIGN PATENT DOCUMENTS

| | | | |
|---|---|---|---|
| GB | 2 316 967 | A | 3/1998 |
| WO | WO 92/20900 | | 11/1992 |
| WO | WO 02/10554 | A1 | 2/2002 |

OTHER PUBLICATIONS

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

Notification of Transmittal of the International Search Report and the Written Opinion of the International Searching Authority, Or the Declaration, Oct. 1, 2009, pp. 1-4, PCT/US2009/046523, Korean Intellectual Property Office.

International Search Report, Oct. 1, 2009, pp. 1-3, PCT/US2009/046523, Korean Intellectual Property Office.

Written Opinion of the International Searching Authority, Oct. 1, 2009, pp. 1-3, PCT/US2009/046523, Korean Intellectual Property Office.

* cited by examiner

PARALLEL FRACTURING SYSTEM FOR WELLBORES

BACKGROUND

1. Field of Invention

The invention is directed to fracturing tools for use in oil and gas wells, and in particular, to fracturing tools capable of directing fracturing fluid in a direction that is parallel to the casing before the fracturing fluid enters the perforations in the wellbore.

2. Description of Art

Fracturing or "frac" systems or tools are used in oil and gas wells for completing and increasing the production rate from the well. In deviated well bores, particularly those having longer lengths, fracturing fluids can be expected to be introduced into the linear, or horizontal, end portion of the well to frac the production zone to open up production fissures and pores therethrough. For example, hydraulic fracturing is a method of using pump rate and hydraulic pressure created by fracturing fluids to fracture or crack a subterranean formation.

In addition to cracking the formation, high permeability proppant, as compared to the permeability of the formation can be pumped into the fracture to prop open the cracks caused by a first hydraulic fracturing step. For purposes of this disclosure, the proppant is included in the definition of "fracturing fluids" and as part of well fracturing operations. When the applied pump rates and pressures are reduced or removed from the formation, the crack or fracture cannot close or heal completely because the high permeability proppant keeps the crack open. The propped crack or fracture provides a high permeability path connecting the producing wellbore to a larger formation area to enhance the production of hydrocarbons.

During fracturing operations, the fracturing fluid is directed from the fracturing tool at a high rate of flow and into a blast liner that redirects the fracturing fluid out of the fracturing tool and into the inner wall surface of the casing within in the well. The fracturing fluid then flows downward in the annulus of the well, i.e., between the outside of the fracturing tool or tool string to which the fracturing tool is connected and the inner wall surface of the wellbore or casing disposed in the wellbore, until it reaches the perforations in the wellbore that are to be packed with the fracturing fluid. As a result of the fracturing fluid flowing out of the fracturing tool and into the inner wall surface of the casing, the casing can be damaged, e.g., eroded by the fracturing fluid impacting the inner wall surface of the casing as soon as it leaves the fracturing tool.

SUMMARY OF INVENTION

Broadly, the fracturing tools disclosed herein comprise an upper isolation device, a lower isolation device, and a housing disposed between the upper and lower isolation devices. In one particular embodiment, the housing comprises a housing bore divided into an upper housing bore and lower housing bore in which the upper housing bore is isolated from the lower housing bore within the housing bore. In other words, fluid within the upper housing bore cannot flow directly into the lower housing bore within the housing bore itself. The upper housing bore comprises one or more ports, also referred to as frac slots, in an outer wall of the upper housing bore so that the upper housing bore is in fluid communication with a wellbore annulus, i.e., between the outer wall surface of the tool and the inner wall surface of the wellbore.

A fluid injection line is in fluid communication with the upper housing bore and releasably aligned or connected to a bore of a conduit string in which the tool is placed. The fluid injection line comprises a lowermost fluid injection line end that terminates within the upper housing bore above the port or ports. Thus, fracturing fluid pumped down the conduit string, through the fluid injection line, out of the lowermost end of the fluid injection line, into the upper housing bore, down the upper housing bore, in a direction that is substantially parallel to a longitudinal length of the tool, and out of the port into the wellbore annulus so fracturing operations can be performed.

Return fluid from the fracturing fluid flows into a screen disposed at a lowermost end of the housing above the lower isolation device. Thus, the screen is in fluid communication with the wellbore annulus. A fluid return line may be disposed within the housing bore which is in fluid communication with the screen. The fluid return line permits the return fluid to flow up through the tool and out of the tool into the wellbore annulus above the upper isolation device. In one particular embodiment, the fluid return line is not disposed within the housing bore, but instead is disposed outside the housing.

Figure 1:
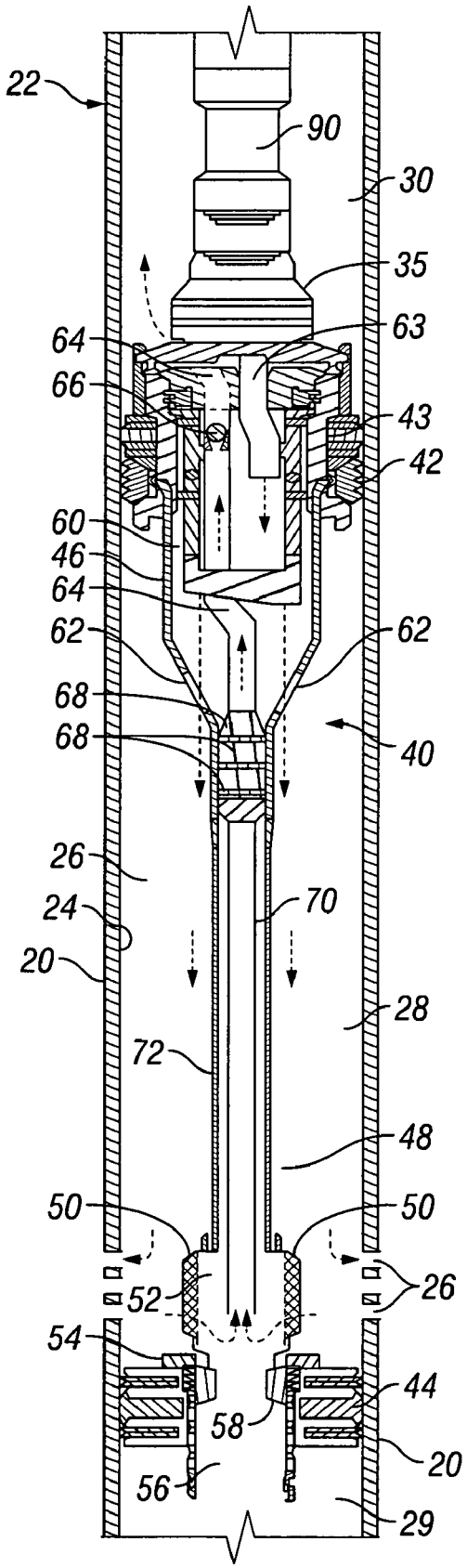
FIG. 1 is a cross-sectional view of one embodiment of the fracturing tool of the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIG. 1, in one specific embodiment, downhole tool 40 is shown disposed within casing 20 of a wellbore 22. Casing 20 includes inner wall surface 24 and one or more perforations 26.

In this embodiment, downhole tool 40 comprises upper isolation device 42 and lower isolation device 44. Upper housing 46, lower housing 48, and screen 50 are disposed between upper isolation device 42 and lower isolation device 44.

Screen 50 includes bore 52 and screen 50 can be releasably secured to lower isolation device 44 through any known device or method, for example, threads (not shown),or snap latch 54. Lower isolation device 44 includes bore 56 that is in fluid communication through which lower portion 58 of screen 50 extends. As shown in FIG. 1, lower isolation device 44 contacts the inner wall surface 24 of casing 20 when lower isolation device 44 is placed in the set position.

In the set position, lower isolation device 44, separates annulus 26 of wellbore 22 into two zones, middle zone 28 disposed above lower isolation device 44 and lower zone 29 disposed below lower isolation device 44. Lower isolation device 44 is shown in the embodiment of FIG. 1 as a sump packer, which is known in the art, however, lower isolation device 44 can be any other isolation device known in the art.

Similarly, in the set position, upper isolation device 42 separates annulus 26 of wellbore 22 into two zones, upper zone 30 disposed above upper isolation device 42 and middle zone 28 disposed below upper isolation device 42. Lower isolation device 42 is shown in the embodiment of FIG. 1 as a high pressure packer, which is known in the art, however, upper isolation device 42 can be any other isolation device known in the art.

Neither upper nor lower isolation devices 42, 44, are required to form a leak-proof seals with the inner wall surface 21 of wellbore 20. Fluid is permitted to flow between upper and lower isolation devices 42, 44 and the inner wall surface 24 of casing 20, provided that the connections between upper and lower isolation devices 42, 44 and the inner wall surface 24 of casing 20 is sufficient to allow wellbore fluid to be transported from downhole tool 40, into middle zone 28 and, subsequently, to upper zone 30 as discussed in greater detail below.

Upper isolation device 42 includes bore 43. Upper housing 46 is disposed within bore 43. Upper housing includes upper housing bore 60 and at least one frac slot 62. Fracturing fluid injection line 63 is disposed within housing bore 60 and is in fluid communication with frac slot 62 such that fluid flows out of fluid injection line 63, into housing bore 60, and out of frac slot 62 in a vector that is parallel, or substantially parallel, to the longitudinal axis of downhole tool 40. As used herein, "substantially parallel" means that the vector of the flow of fluid out of fluid injection line 63, into housing bore 60, and out of frac slot 62 is not changed by more than 45 degrees from the longitudinal axis of downhole tool 40 during transition from fluid injection line 63 into housing bore 60 or from housing bore 60 through frac slot 62. In one specific embodiment, the flow of fluid out of fluid injection line 63, into housing bore 60, and out of frac slot 62 is not changed by more than 30 degrees from the longitudinal axis of downhole tool 40 during transition from fluid injection line 63 into housing bore 60 or from housing bore 60 through frac slot 62. In another specific embodiment, the flow of fluid out of fluid injection line 63, into housing bore 60, and out of frac slot 62 is not changed by more than 15 degrees from the longitudinal axis of downhole tool 40 during transition from fluid injection line 63 into housing bore 60 or from housing bore 60 through frac slot 62. Further, it is to be understood that the term "substantially parallel" also includes "parallel" in which the vector of the flow of fluid during transition from fluid injection line 63 into housing bore 60 or from housing bore 60 through frac slot 62, is unchanged and, thus, parallel to the longitudinal axis of downhole tool 40.

Also disposed within housing bore 60 is return line 64. Return line 64 can include one-way check valve 66 to prevent backflow from occurring within return line 64. In the embodiment shown in FIG. 1, return line 64 includes at least one concentric seal 68 to seal the outer wall surface of return line 64 with the inner wall surface of housing bore 60.

Return line 64 is in fluid communication with wash pipe 70 that is disposed within lower housing bore 72. Because concentric seals 68 isolate upper housing bore 60 from lower housing bore 72, return fluids are forced to travel up the bore of wash pipe 70 and into return line 64.

Return line 64 is also in fluid communication with upper zone 30 so that return fluid is transported into the wellbore above upper isolation device 42 where it can then travel to the surface of the well for recirculation as desired or needed for additional wellbore operations.

Lower housing 48 is secured to upper housing 46 through any method or device known to persons skilled in the art, such as through welding or threads (not shown). Lower housing 48 can also be secured to screen 50 through any method or device known to persons skilled in the art, such as through welding or threads (not shown).

In one particular operation of downhole tool 40, a tubing string 90 is used to dispose downhole tool 40 into casing 20 of wellbore 22. After disposition within casing 20, upper and lower isolation devices 42, 44 are activated so that annulus 26 of wellbore 22 is divided into middle zone 28, lower zone 29, and upper zone 30. Activation of upper and lower isolation devices 42, 44 can be accomplished using known methods. In one particular embodiment, upper isolation device 42 is set using setting tool 35.

With particular reference to the arrows shown in FIG. 1 that illustrate fluid flow through downhole tool 40, after setting upper and lower isolation devices 42, 44 within casing 20, fracturing fluid, such as proppant, is pumped work string 90 into and through fracturing fluid injection line 63 into housing bore 60 and out of frac slot 62. The fracturing fluid then flows down annulus 26 within middle zone 28 until it reaches casing perforations 26. The fracturing fluid then enters casing perforations 26 until fracturing operations are completed.

During operations, liquids such as water and, possibly gases, that are contained within the fracturing fluid are permitted to flow through screen 50. The larger particulate matter within the fracturing fluid, such as gravel or sand, is not permitted to pass through screen 50. This liquid or gas then mixes with other fluids contained within lower zone 29 of wellbore 22 and flows up wash pipe 70, into return line 64, through one-way check valve 66 and into upper zone 30 so that it can travel within wellbore 22 up toward the surface of wellbore 22. After an amount of time as passed to fracture the wellbore as desired or necessary to stimulate hydrocarbon production from the well, fracturing fluid is no longer pumped downward through fracturing fluid injection line 63.

As a result of the pathway of flow for the fracturing fluid through fracturing fluid injection line 63, into housing bore 60, and out of frac slot 62, the fracturing fluid is ejected from downhole tool 40 into annulus 26 at a rate such that likelihood of erosion of casing 20 is lessened. This is because the flow of the fracturing fluid out of injection line 63 is substantially parallel to inner wall surface 24 of casing 20.

In the embodiments discussed herein with respect FIG. 1, upward, toward the surface of wellbore 22, is toward the top of FIG. 1, and downward or downhole (the direction going away from the surface of wellbore 22) is toward the bottom of FIG. 1. In other words, "upward" and "downward" are used with respect to FIG. 1 as describing the vertical orientation illustrated in FIG. 1. However, it is to be understood that downhole tool 40 may be disposed within a horizontal or other deviated well so that "upward" and "downward" are not oriented vertically.

It is to be understood that the invention is not limited to the exact details of construction, operation, exact materials, or embodiments shown and described, as modifications and equivalents will be apparent to one skilled in the art. For example, the upper and lower isolation devices can be any isolation device known in the art. Further, the inner wall surface of the wellbore may be disposed along an open-hole formation, along wellbore casing (as shown in FIG. 1), or along a tubular member, including a packer or bridge plug, disposed within the wellbore casing or open hole formation. Moreover, the term "wellbore annulus" is to be understood to be the environment outside of the downhole fracturing tools, regardless of whether the downhole fracturing tool is actually disposed within a wellbore. Further, the wellbore may be cased or opened-hole. Accordingly, the invention is therefore to be limited only by the scope of the appended claims.

What is claimed is:

1. A downhole fracturing tool for fracturing operations in a wellbore annulus of a wellbore, the downhole fracturing tool comprising:

an upper isolation device;

a lower isolation device;

a housing disposed between the upper and lower isolation devices, the housing comprising a housing bore, the housing bore comprising upper housing bore and lower housing bore, the upper housing bore being isolated from the lower housing bore within the housing bore, and the upper housing bore comprising a port in fluid communication with a wellbore annulus;

a fluid injection line in fluid communication with the upper housing bore, the fluid injection line comprising a lowermost fluid injection line end, the lowermost fluid injection line end being disposed above and in substantial axial alignment with the port, the port being disposed in the upper housing bore at a location for directing fluid flow from the fluid injection line out of the upper housing bore into an annulus of a wellbore in a downward direction, the downward direction comprising an angle that is substantially parallel to a longitudinal axis of the downhole fracturing tool;

a screen disposed at a lowermost end of the housing above the lower isolation device, the screen being in fluid communication with the wellbore annulus and a fluid return line, the fluid return line being disposed within the housing bore and in fluid communication with the wellbore annulus above the upper isolation device.

2. The downhole fracturing tool of claim 1, wherein the fluid return line is in fluid communication with a wash pipe disposed within the lower housing bore, the wash pipe being in fluid communication with the screen.

3. The downhole fracturing tool of claim 1, wherein the screen is releasably secured to the lower isolation device by a snap latch.

4. The downhole fracturing tool of claim 1, wherein the return line includes a one-way check valve.

5. The downhole fracturing tool of claim 1, wherein the upper housing bore is isolated from the lower housing bore by at least one isolation seal disposed on an outer wall surface of the fluid return line.

6. The downhole fracturing tool of claim 5, wherein the fluid return line comprises a seal housing disposed at a lower end of the fluid return line, the seal housing having at least one seal for isolating the upper housing bore from the lower housing bore and the seal housing being in fluid communication with a wash pipe disposed within the lower housing bore, the wash pipe being in fluid communication with the screen.

7. The downhole fracturing tool of claim 6, wherein the upper isolation device is a high pressure packer and the lower isolation device is a sump packer.

8. The downhole fracturing tool of claim 7, wherein the upper housing bore comprises an upper housing bore diameter that is larger than a lower housing bore diameter of the lower housing bore.

9. A downhole fracturing tool for fracturing operations in a wellbore annulus of a wellbore, the downhole fracturing tool comprising:

a fluid injection line;

a fluid return line; and a housing, the housing comprising an upper isolation device, a lower isolation device, and a housing bore comprising an upper housing bore isolated within the housing bore from a lower housing bore, the lower housing bore comprising a screen in fluid communication with a wellbore annulus and the fluid return line, the fluid return line being disposed within the upper and lower housing bores, the fluid return line being isolated from the upper housing bore within the housing bore, the fluid return line also being in fluid communication with the wellbore annulus above the upper isolation device, and the upper housing bore comprising a port in fluid communication with the wellbore annulus and the fluid injection line, wherein the fluid injection line comprises a lowermost fluid injection line end, and wherein the port is disposed in the upper housing bore at a location for directing fluid flow out of the upper housing bore into the wellbore annulus in a downward direction, the downward direction comprising an angle that is substantially parallel to a longitudinal axis of the downhole fracturing tool, the port being disposed below and in substantial axial alignment with the lowermost fluid injection line end.

10. The downhole fracturing tool of claim 9, wherein the fluid return line is in fluid communication with a wash pipe disposed within the lower housing bore, the wash pipe being in fluid communication with the screen.

11. The downhole fracturing tool of claim 9, wherein the screen is releasably secured to the lower isolation device by a snap latch.

12. The downhole fracturing tool of claim 9, wherein the upper housing bore is isolated from the lower housing bore by at least one isolation seal disposed on an outer wall surface of the fluid return line.

13. The downhole fracturing tool of claim 12, wherein the fluid return line comprises a seal housing disposed at a lower end of the fluid return line, the seal housing having at least one seal for isolating the upper housing bore from the lower housing bore and the seal housing being in fluid communication with a wash pipe disposed within the lower housing bore, the wash pipe being in fluid communication with the screen.

14. The downhole fracturing tool of claim 13, wherein the upper isolation device is a high pressure packer and the lower isolation device is a sump packer.

15. The downhole fracturing tool of claim 14, wherein the upper housing bore comprises an upper housing bore diameter that is larger than a lower housing bore diameter of the lower housing bore.

16. The downhole fracturing tool of claim 9, wherein the return line includes a one-way check valve.

17. A method of fracturing a wellbore, the method comprising the steps of:

(a) running a downhole fracturing tool on a conduit string down a wellbore, the downhole fracturing tool comprising an upper isolation device, a lower isolation device, a screen disposed above the lower isolation device, and a fluid injection line disposed within a housing, the injection line having a lower injection end within the housing and the housing having a port disposed in an outer wall surface of the housing, the port being in fluid communication with the fluid injection line and a wellbore annulus and being disposed below and in substantial axial alignment with the lower injection end of the injection line, the screen being disposed below the port and in fluid communication with a wellbore annulus and a fluid return line disposed within the housing of the downhole fracturing tool;

(b) setting the upper and lower isolation devices within the wellbore; and (c) pumping a fracturing fluid down the conduit string, through the injection line, into the housing, down a bore of the housing, and out of the port into the wellbore annulus in a downward direction, the downward direction comprising an angle that is substantially parallel to a longitudinal axis of the downhole fracturing tool.

18. The method of claim 17, wherein the fracturing fluid is returned to a surface of the wellbore by flowing the fracturing fluid through the screen, and up the fluid return line.

19. The method of claim 18, wherein the fracturing fluid flows from the fluid return line and out of the downhole fracturing tool above the upper isolation device.

20. The method of claim 17, wherein during step (b), the downhole fracturing tool is disposed within the wellbore so that the screen is substantially aligned with at least one perforation disposed within an inner wall surface of the wellbore.

* * * * *